US008371876B2

(12) United States Patent
Davis

(10) Patent No.: US 8,371,876 B2
(45) Date of Patent: Feb. 12, 2013

(54) INCREASED DENSITY CONNECTOR SYSTEM

(75) Inventor: Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 395 days.

(21) Appl. No.: 12/712,052

(22) Filed: Feb. 24, 2010

(65) Prior Publication Data

US 2011/0207342 A1 Aug. 25, 2011

(51) Int. Cl.
*H01R 13/648* (2006.01)

(52) U.S. Cl. ..... 439/607.07; 439/108; 439/607.08

(58) Field of Classification Search ..... 439/607.05–607.08, 79, 108
See application file for complete search history.

(56) References Cited

U.S. PATENT DOCUMENTS 6,843,687 B2 * 1/2005 McGowan et al. ..... 439/607.06
6,899,566 B2 * 5/2005 Kline et al. ..... 439/607.56
7,594,826 B2 * 9/2009 Kobayashi et al. ..... 439/607.07
7,651,373 B2 * 1/2010 Knaub et al. ..... 439/607.05
7,862,344 B2 * 1/2011 Morgan et al. ..... 439/67

OTHER PUBLICATIONS

U.S. Patent Application, Orthogonal Connector System, U.S. Appl. No. 12/353,550, filed Jan. 14, 2009, Assignee: Tyco Electronics Corporation, (35) pgs.

* cited by examiner

*Primary Examiner* — Hien Vu

(57) ABSTRACT

A connector system is provided for electrically connecting a receptacle printed circuit to a header printed circuit. The connector system includes a header assembly configured to be mounted on the header printed circuit. The header assembly includes header contacts. A receptacle assembly is configured to be mounted on the receptacle printed circuit and mated with the header assembly. The receptacle assembly includes a housing and a contact module held within the housing. The contact module has separate first and second chicklets that are coupled together to define the contact module. First and second receptacle contacts are held by the contact module and arranged in a differential pair. The first and second receptacle contacts are engaged with the header contacts of the header assembly. The first receptacle contact of the differential pair is held by the first chicklet and the second receptacle contact of the differential pair is held by the second chicklet.

20 Claims, 9 Drawing Sheets

INCREASED DENSITY CONNECTOR SYSTEM

BACKGROUND OF THE INVENTION

The subject matter described and/or illustrated herein relates generally to electrical connectors, and more particularly, to increasing the density of electrical connectors.

Some electrical systems utilize electrical connectors to interconnect two printed circuits to one another. For example, electrical systems such as network switches and computer servers may include backplanes that receive several daughter cards, such as switch cards or line cards. The electrical systems utilize electrical connectors to interconnect the printed circuits defining the cards to the printed circuit defining the backplane. The electrical connectors are typically right angle connectors mounted to an edge of the printed circuits. The electrical connectors are mated with header connectors mounted to a common midplane.

Known electrical systems that utilize electrical connectors mated together through a midplane are not without disadvantages. For instance, a large number of switch cards and line cards are typically connected to the backplane, which increases the overall size of the backplane. The density of the electrical connectors has an impact on the overall size of the electrical connectors, and thus the overall size of the backplane. The density may be expressed in terms of the number of signal contacts or pairs of signal contacts per linear inch of the electrical connector. While decreasing the spacing between the signal contacts is one way of increasing the density, decreasing the spacing may negatively affect the electrical performance of the electrical connector. The amount of undesirable coupling between adjacent signal contacts is based at least in part on the distance between the signal contacts. As such, merely changing the spacing between the signal contacts may not be an effective way to increase the density of the electrical connector, as the electrical connector may not perform adequately.

One method of reducing undesirable coupling and corresponding signal degradation between adjacent signals may be achieved by surrounding particular signal contacts or pairs of signal contacts with ground contacts. However, adding ground contacts reduces the overall density of the electrical connector by taking up space, thus increasing the spacing between the signal contacts or pairs of signal contacts. Thus, increasing the density of an electrical connector, while maintaining or reducing signal loss, remains a challenge.

BRIEF DESCRIPTION OF THE INVENTION

In one embodiment, a connector system is provided for electrically connecting a receptacle printed circuit to a header printed circuit. The connector system includes a header assembly configured to be mounted on the header printed circuit. The header assembly includes header contacts. A receptacle assembly is configured to be mounted on the receptacle printed circuit and mated with the header assembly. The receptacle assembly includes a housing and a contact module held within the housing. The contact module has separate first and second chicklets that are coupled together to define the contact module. First and second receptacle contacts are held by the contact module and arranged in a differential pair. The first and second receptacle contacts are engaged with the header contacts of the header assembly. The first receptacle contact of the differential pair is held by the first chicklet and the second receptacle contact of the differential pair is held by the second chicklet.

In another embodiment, an orthogonal connector system is provided for electrically connecting a receptacle printed circuit to a header printed circuit that is oriented orthogonally with respect to the receptacle printed circuit. The orthogonal connector system includes a header assembly configured to be mounted on the header printed circuit along a header mounting edge. The header assembly includes header contacts. A receptacle assembly is mated with the header assembly. The receptacle assembly is configured to be mounted on the receptacle printed circuit along a receptacle mounting edge that is generally orthogonal with respect to the header mounting edge. The receptacle assembly includes a housing and a contact module held within the housing. The contact module has separate first and second chicklets that are coupled together to define the contact module. First and second receptacle contacts are held by the contact module and arranged in a differential pair. The first and second receptacle contacts are engaged with the header contacts of the header assembly. The first receptacle contact of the differential pair is held by the first chicklet and the second receptacle contact of the differential pair is held by the second chicklet.

DETAILED DESCRIPTION OF THE INVENTION

Figure 1:
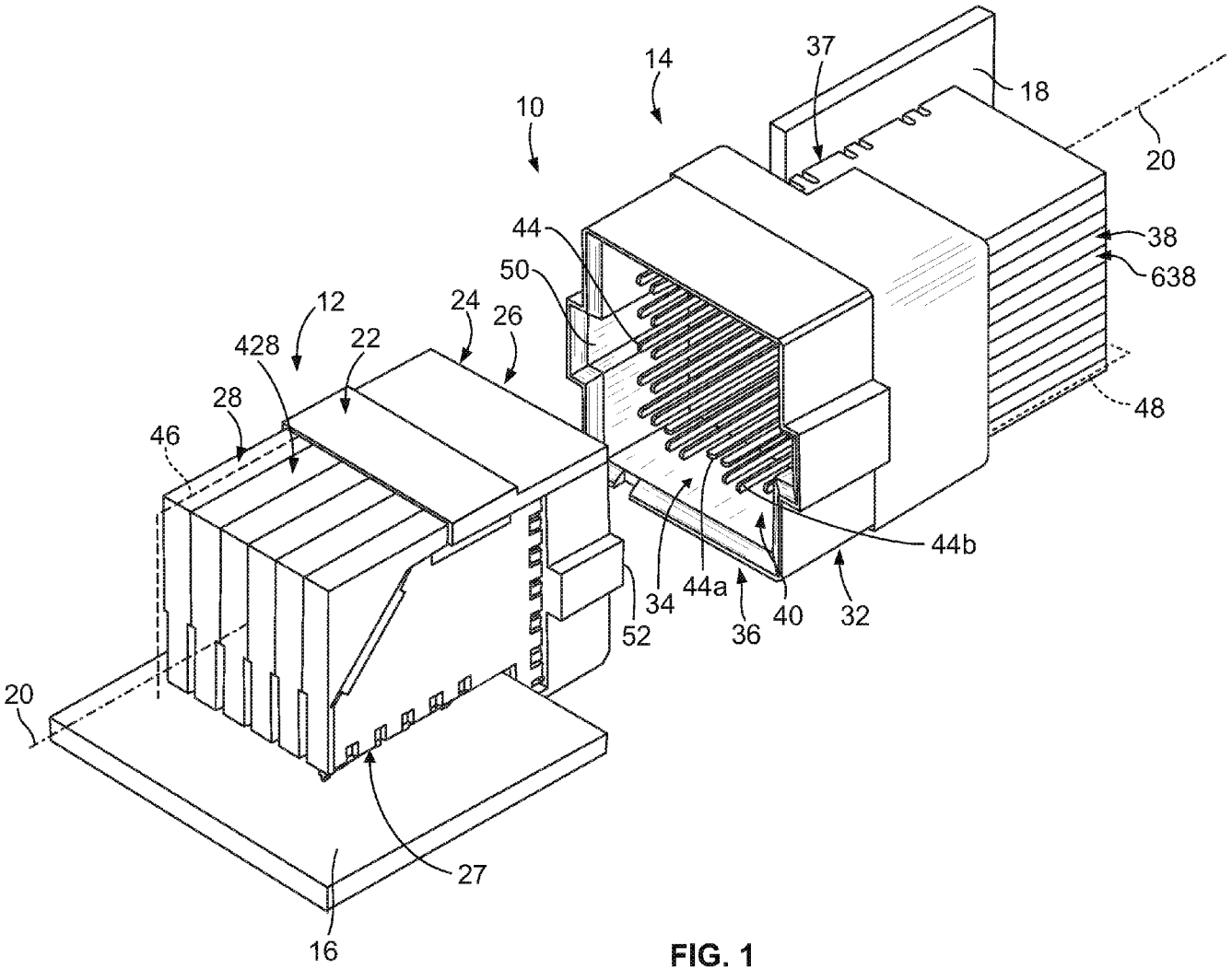
FIG. 1 is a perspective view of an exemplary embodiment of an electrical connector system.

FIG. 1 is a perspective view of an exemplary embodiment of an electrical connector system 10. The system 10 includes two connector assemblies 12 and 14 that may be directly connected to one another. The connector assemblies 12 and 14 are each mounted on a respective printed circuit 16 and 18. The connector assemblies 12 and 14 electrically connect the printed circuits 16 and 18 together without the use of a midplane printed circuit. The connector assemblies 12 and 14 are mated with one another in a direction parallel to and along a mating axis 20. When mated, an electrical connection is established between the connector assemblies 12 and 14, and a corresponding electrical connection is established between the printed circuits 16 and 18. The connector assembly 14 may be fixed within an electronic device such as host device, a computer, a network switch, a computer server, and/or the like, while the connector assembly 12 may be part of an external device being electrically connected to the electronic device, or vice versa.

In the exemplary embodiment, the printed circuits 16 and 18 are generally orthogonal to one another and the connector assemblies 12 and 14 are generally orthogonal to one another. In the exemplary embodiment, both the printed circuits 16 and 18 extend generally parallel to the mating axis 20. However, the connector assembly 12, the connector assembly 14, the printed circuit 16, the printed circuit 18, and/or the mating axis 20 may have other relative orientations. In the exemplary embodiment, the connector assembly 12 constitutes a receptacle assembly, and may be referred to hereinbelow as "receptacle assembly 12". The connector assembly 14 constitutes a header assembly, and may be referred to hereinbelow as "header assembly 14".

The receptacle assembly 12 includes a housing 22 having a mating face 24 at a front 26 of the housing 22. The receptacle assembly 12 is mounted on the printed circuit 16 along a mounting edge 27 of the receptacle assembly 12. A plurality of contact modules 28 and 428 are held by the housing 22. The contact modules 28 and 428 are electrically connected to the printed circuit 16. The mating face 24 is oriented generally perpendicular to the printed circuit 16, the mating axis 20, and the mounting edge 27. Similar to the receptacle assembly 12, the header assembly 14 includes a housing 32 having a mating face 34 at a front 36 of the housing 32. The header assembly 14 is mounted on the printed circuit 18 along a mounting edge 37 of the header assembly 14. The mounting edges 27 and 37 of the assemblies 12 and 14, respectively, are generally orthogonal to one another. The housing 32 holds a plurality of contact modules 38 and 638 that are electrically connected to the printed circuit 18. The mating face 34 is oriented generally perpendicular to the printed circuit 18 and the mating axis 20. The housing 32 of the header assembly 14 includes a chamber 40 that receives at least a portion of the receptacle assembly 12. An array of mating contacts 44 is arranged within the chamber 40 for mating with corresponding mating contacts 42 (FIGS. 3-7 and 11) of the receptacle assembly 12. The mating contacts 44 extend from corresponding contact modules 38 and 638 into the chamber 40 and are electrically connected to the printed circuit 18 via corresponding electrical leads (not shown) of the contact modules 38 and 638. The mounting edges 27 and 37 may be referred to herein as a "receptacle mounting edge" and a "header mounting edge", respectively.

The contact modules 28 and 428 of the receptacle assembly 12 are each arranged along parallel receptacle assembly contact module planes 46, one of which is shown in FIG. 1. Similarly, the contact modules 38 and 638 of the header assembly 14 are each arranged along parallel header assembly contact module planes 48, one of which is shown in FIG. 1. The receptacle assembly contact module planes 46 are oriented generally perpendicular with respect to the header assembly contact module planes 48. The receptacle assembly contact module planes 46 are oriented generally parallel with respect to the printed circuit 18. The header assembly contact module planes 48 are oriented generally parallel with respect to the printed circuit 16.

The housing 32 of the header assembly 14 includes optional alignment features 50 in the exemplary form of grooves that open at the chamber 40. The alignment features 50 are configured to interact with corresponding optional alignment features 52 on the housing 22 of the receptacle assembly 12. The exemplary alignment features 52 on the housing 22 are in the form of projections that extend outward from the housing 22. The alignment features 50 and 52 may have different shapes and/or may be a different type in alternative embodiments. The alignment features 50 and 52 orient and/or guide the receptacle assembly 12 and header assembly 14 in an orthogonal orientation with respect to one another. In another alternative embodiment, the alignment features 50 and 52 may represent polarization or keying features that are configured to align the housings 22 and 32 in only one mating orientation.

Figure 2:
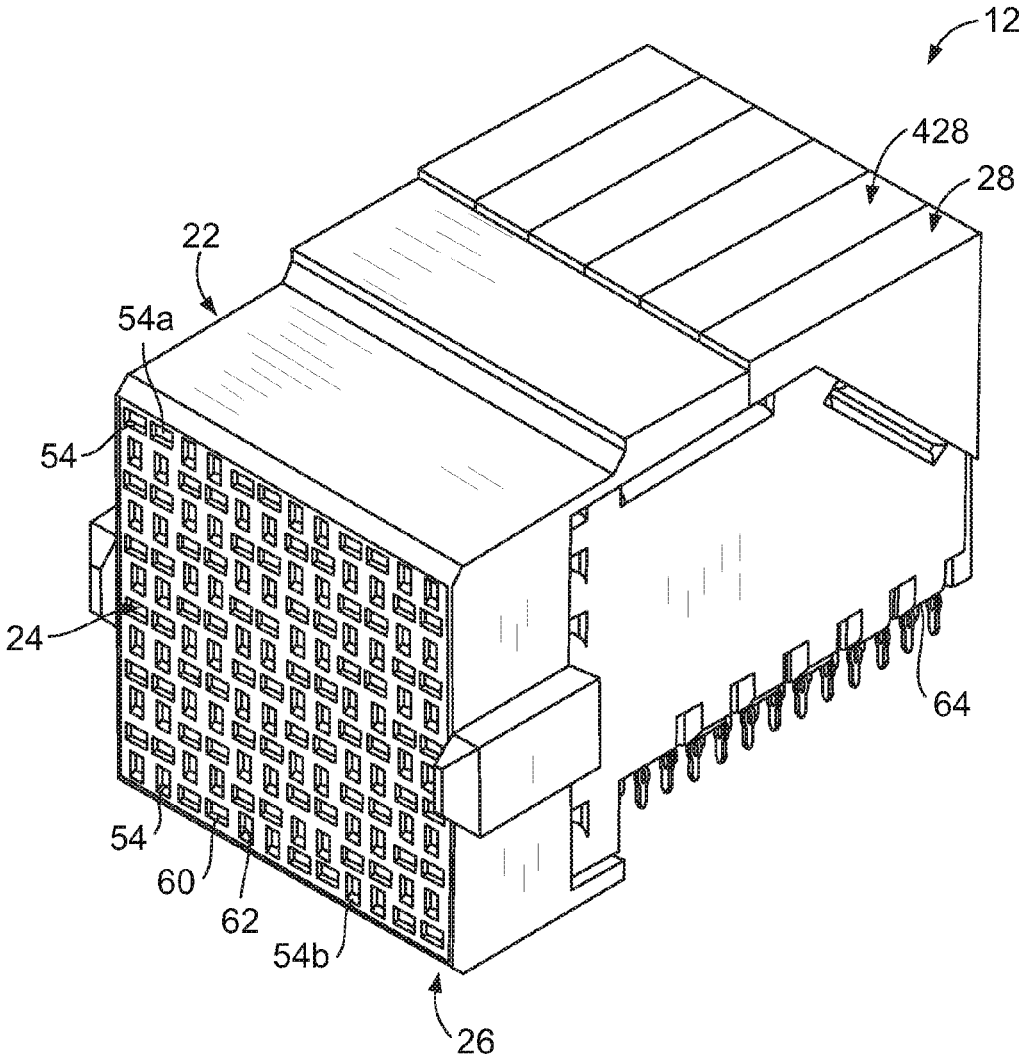
FIG. 2 is a perspective view of an exemplary embodiment of a receptacle assembly of the electrical connector system shown in FIG. 1.

FIG. 2 is a perspective view of an exemplary embodiment of the receptacle assembly 12. The housing 22 includes a plurality of contact channels 54 open at the front 26. The mating contacts 42 (FIGS. 3-7 and 11) include signal contacts 42*a* and ground contacts 42*b*. The contact modules 28 and 428 include the signal contacts 42*a*, which extend into the contact channels 54. The receptacle assembly 12 optionally includes two different types of contact modules, namely an A type (the contact module 28) and a B type (the contact module 428) of contact module. The A and B types of contact modules 28 and 428, respectively, differ in their arrangement of signal and ground contacts 42*a* and 42*b*, respectively, as will be described in further detail below.

The contact channels 54 include both signal contact channels 54*a* and ground contact channels 54*b*. The signal contact channels 54*a* hold mating ends 56*a* (FIGS. 3-7 and 11) of the signal contacts 42*a*. The signal contact channels 54*a* are configured to receive mating ends 58*a* (FIGS. 8-11) of signal contacts 44*a* (FIGS. 1 and 8-11) of the mating contacts 44 (FIGS. 1 and 8-11) of the header assembly 14 (FIGS. 1, 8, and 11). The signal contact channels 54*a* are arranged in a pattern that complements the pattern of the mating ends 56*a* and 58*a* of the signal contacts 42*a* and 44*a*, respectively, and are defined by channel walls 60. In the exemplary embodiment, the channel walls 60 define signal contact channels 54*a* that have a rectangular cross-section. But, the signal contact channels 54*a* may additionally or alternatively include any other shape.

The ground contact channels 54*b* hold mating ends 56*b* (FIGS. 3, 4, 6, 7, and 11) of the ground contacts 42*b* (FIGS. 3, 4, 6, 7, and 11) and are configured to receive mating ends 58*b* (FIGS. 8-11) of ground contacts 44*b* (FIGS. 1 and 8-11) of the header assembly 14. The ground contact channels 54*b* are arranged in a pattern that complements the pattern of the mating ends 56*b* and 58*b* of the ground contacts 42*b* and 44*b*, respectively. The ground contact channels 54*b* are defined by channel walls 62. Although shown as having a rectangular cross-section, the ground contact channels 54*b* may additionally or alternatively include any other shape.

The contact modules 28 and 428 are each configured to be electrically connected to the printed circuit 16 at a corresponding mounting face 64. The mounting faces 64 combine to define the mounting edge 27 of the receptacle assembly 12. In the exemplary embodiment, the mating face 24 is oriented generally perpendicular with respect to the mounting face 64 and the mating axis 20. Different relative orientations are possible in alternative embodiments.

Figure 3:
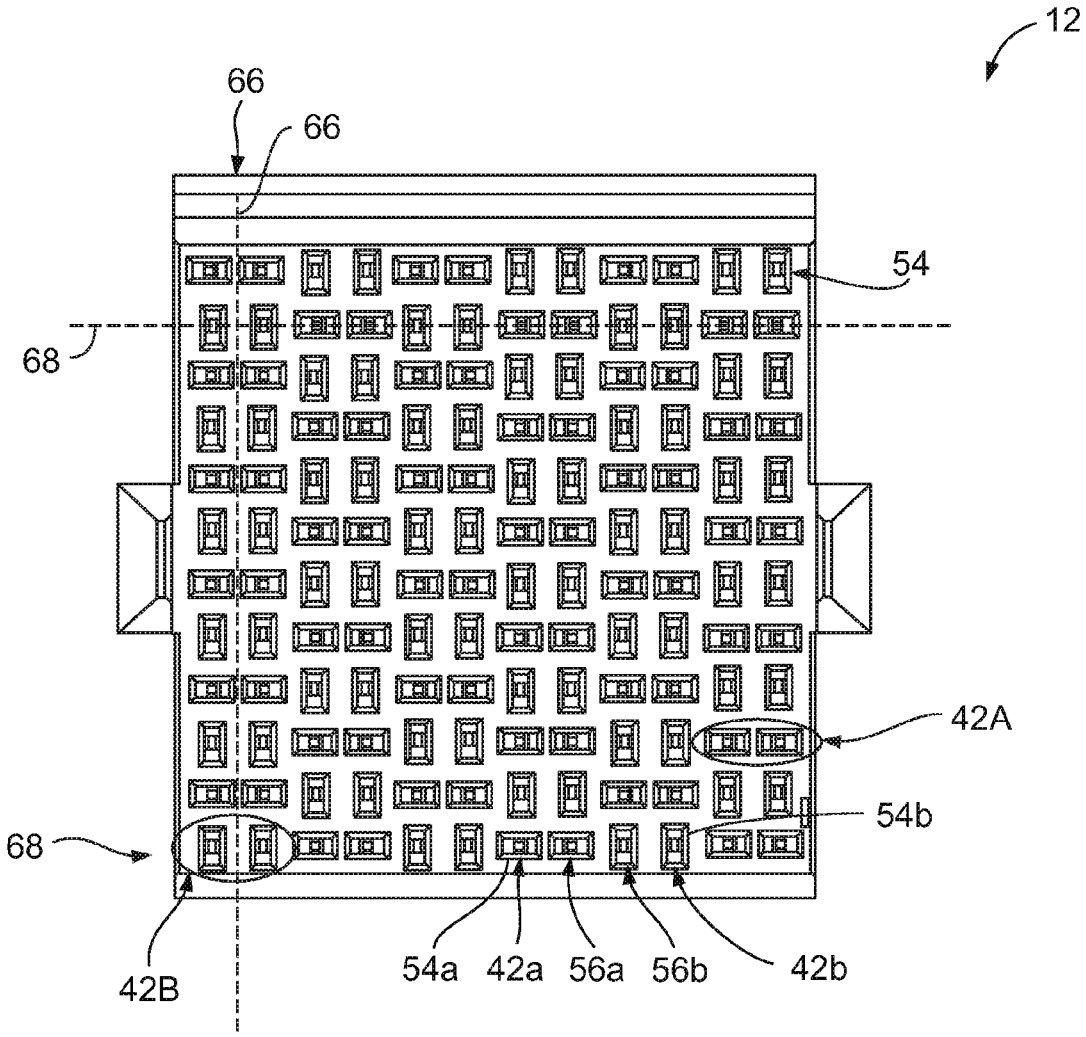
FIG. 3 is a front elevational view of the receptacle assembly shown in FIG. 2.

FIG. 3 is a front elevational view of the receptacle assembly 12 illustrating the mating ends 56*a* and 56*b* of the signal contacts 42*a* and ground contacts 42*b*, respectively. The mating ends 56*a* and 56*b* of the signal contacts 42*a* and the ground contacts 42*b*, respectively, are received in corresponding signal and ground contact channels 54*a* and 54*b*, respectively. The mating ends 56*a* and 56*b* are arranged in a matrix of columns and rows 66 and 68, respectively. The mating ends 56*a* of the signal contacts 42*a* are arranged in differential pairs 42A, with adjacent differential pairs 42A being separated by mating ends 56*b* of ground contacts 42*b*. The mating ends 56*a* of the signal contacts 42*a* within each differential pair 42A are aligned with one another within one of the rows 68.

Within each row 68, adjacent differential pairs 42A of signal contact mating ends 56*a* are separated by a pair 42B of mating ends 56*b* of the ground contacts 42*b*. Similarly, within each column 66, adjacent differential pairs 42A are separated by a pair 42B of ground contact mating ends 56*b*. In adjacent columns 66, the pattern of signal contact mating ends 56*a* and ground contact mating ends 56*b* alternates. In some alternative embodiments, adjacent differential pairs 42A of signal contact mating ends 56*a* within a column 66 and/or within a row 68 are separated by any other number of mating ends 56*b* of ground contacts 42*b*, such as, but not limited to, one or three ground contact mating ends 56*b*.

Figure 4:
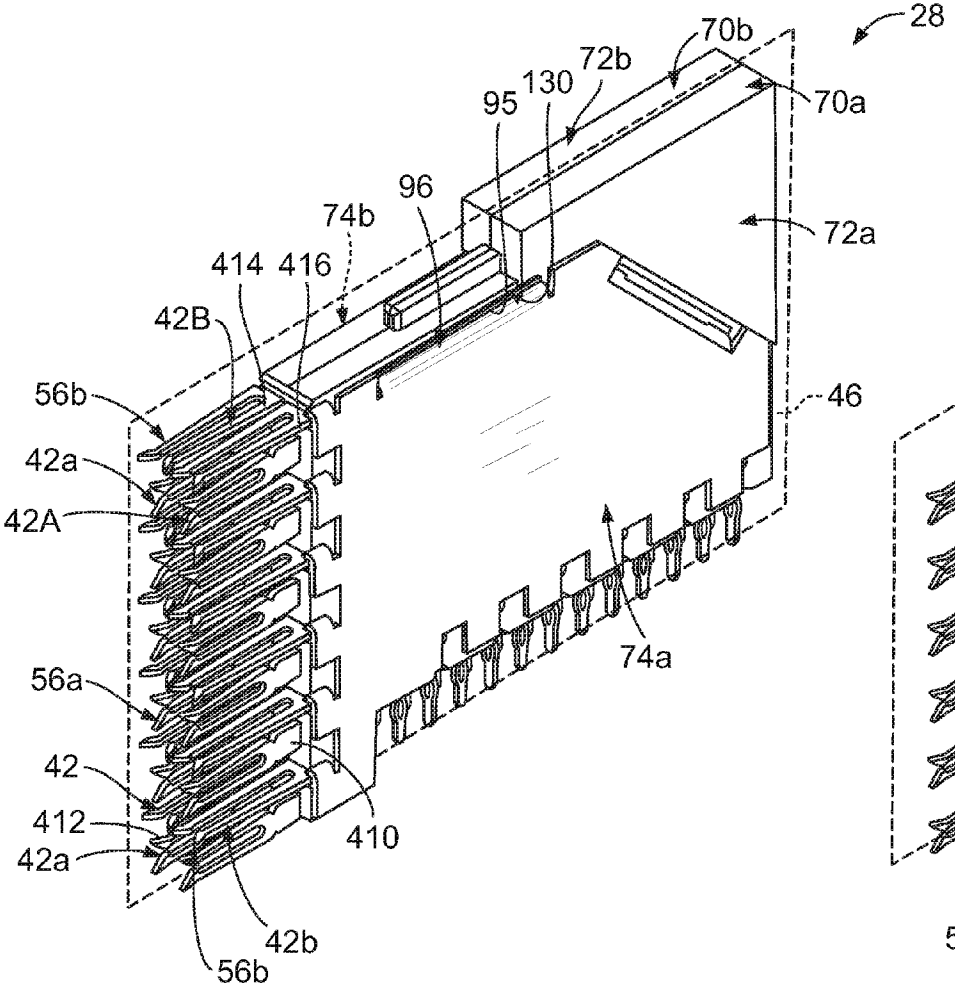
FIG. 4 is a perspective view an exemplary embodiment of a contact module of the receptacle assembly shown in FIGS. 2 and 3.

FIG. 4 is a perspective view an exemplary embodiment of a contact module 28 of the receptacle assembly 12 (FIGS. 1-3 and 11). The contact module 28 includes two chicklets 70*a* and 70*b*. The chicklets 70*a* and 70*b* are separate and discrete from one another. The chicklets 70*a* and 70*b* are coupled together along the contact module plane 46 to form the contact module 28. The contact module plane 46 may be centered along the contact module 28. Optionally, the chicklets 70*a* and 70*b* are generally mirrored halves that are coupled together to form the contact module 28, and include complementary mating features that hold the mirrored halves together. Once the chicklets 70*a* and 70*b* are coupled together, the contact module 28 may be loaded into the housing 22 (FIGS. 1 and 2).

The chicklet 70*a* includes a body 72*a* that holds one of the signal contacts 42*a* of each differential pair 42A. A ground shield 74*a* is coupled to the body 72*a*. One of the ground contacts 42*b* of each pair 42B extends outward from the ground shield 74*a*. The chicklet 70*b* also includes a body 72*b* that holds the other signal contact 42*a* of each differential pair 42A. A ground shield 74*b* coupled to the body 72*b* includes the other ground contacts 42*b* of each pair 42B.

When assembled, the mating ends 56*a* of the signal contacts 42*a* of both the chicklets 70*a* and 70*b* are aligned with one another on opposite sides of the contact module plane 46. The signal contact mating ends 56*a* are arranged in the differential pairs 42A, with one of the mating ends 56*a* of the differential pair 42A being held by the chicklet 70*a* on one side of the contact module plane 46 and the other mating end 56*a* of the differential pair 42A being held by the chicklet 70*b* on the opposite side of the contact module plane 46. When assembled, the mating ends 56*b* of the ground contacts 42*b* of both the chicklets 70*a* and 70*b* are aligned with one another on opposite sides of the contact module plane 46. One of the mating ends 56*b* of each of the pairs 42B of ground contacts 42*b* is held by the chicklet 70*a* on one side of the contact module plane 46 and the other mating end 56*b* of the pair 42B is held by the chicklet 70*b* on the opposite side of the contact module plane 46.

In the exemplary embodiment, the mating end 56*b* of each ground contact 42*b* includes two beams that engage opposite sides of the mating end 58*b* (FIGS. 8-11) of the corresponding ground contact 44*b* (FIGS. 1 and 8-11) when the mating end 58*b* is loaded therebetween. Optionally, the two beams may have different lengths to sequence the mating of the ground contact set with the corresponding ground contact 44*b*. As such, the mating forces may be reduced and/or the stub effect may be reduced.

Figure 5:
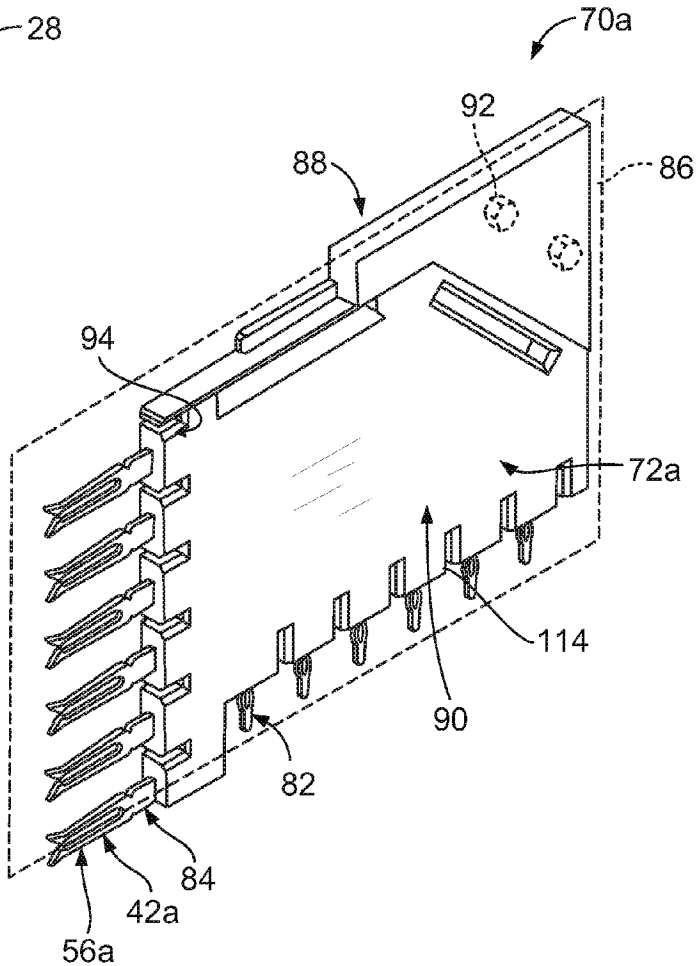
FIG. 5 is a perspective view of an exemplary embodiment of a chicklet that forms part of the contact module shown in FIG. 4.

FIG. 5 is a perspective view of the chicklet 70*a*, which forms a part of the contact module 28 (FIGS. 1, 2, 4, 6, and 11). In the exemplary embodiment, the chicklet 70*a* is formed with an overmolded lead frame type of structure, however the chicklet 70*a* is not limited to such structure. The body 72*a* is formed by the dielectric material of the overmold, which encases a lead frame (not shown). The lead frame includes a plurality of stamped and formed metal conductors initially held together by a frame or carrier (not shown) that is ultimately removed. The metal conductors define the signal contacts 42*a*. The signal contacts 42*a* are configured to carry data signals. In some alternative embodiments, other types of contacts may be provided in addition to, or in the alternative to, the signal contacts 42*a*, such as ground contacts, power contacts, and the like. In the exemplary embodiment, the signal contacts 42*a* of the chicklet 70*a* are not arranged to carry differential pair signals with other signal contacts 42*a* of the chicklet 70*a*, but rather are configured to carry data signals that are independent from one another. However, the signal contacts 42*a* of the chicklet 70*a* cooperate with corresponding signal contacts 42*a* of the chicklet 70*b* (FIGS. 4 and 6) to carry differential pair signals. Hence, the signal contacts 42*a* in the chicklet 70*a* that are arranged adjacent one another and in a common vertical column are associated with different differential pairs.

The signal contacts 42*a* include the mating end 56*a* and a mounting end 82 that are both exposed beyond edges of the body 72*a*. In the exemplary embodiment, the mounting end 82 constitutes an eye of the needle type contact that is configured to be received within a via of the printed circuit 16. The mating end 56*a* extends forwardly from a front end of the body 72*a*. In the exemplary embodiment, the mating end 56*a* constitutes a tuning fork style of contact that is configured to receive and mate with the blade type mating end 58*a* (FIGS. 8-11) of the corresponding signal contact 44*a* (FIGS. 1 and 8-11). Other types of contacts may be used in alternative embodiments for mating with the blade type of signal contact 44*a* or other types of signal contacts. The mating end 56*a* includes an optional jogged section 84 that transitions the mating end 56*a* out of plane with respect to other portions of the signal contact 42*a*.

The signal contacts 42*a* transition between the mating and mounting ends 56*a* and 82 within the body 72*a*. In the exemplary embodiment, the chicklet 70*a* is a right angle chicklet with the mating end 56*a* being oriented generally perpendicular with respect to the mounting end 82. The signal contacts 42*a* are generally coplanar with one another along a lead frame plane 86. The lead frame plane 86 may be substantially centered within the body 70*a*. The jogged section 84 may transition the mating end 56*a* out of the lead frame plane 86.

Figure 6:
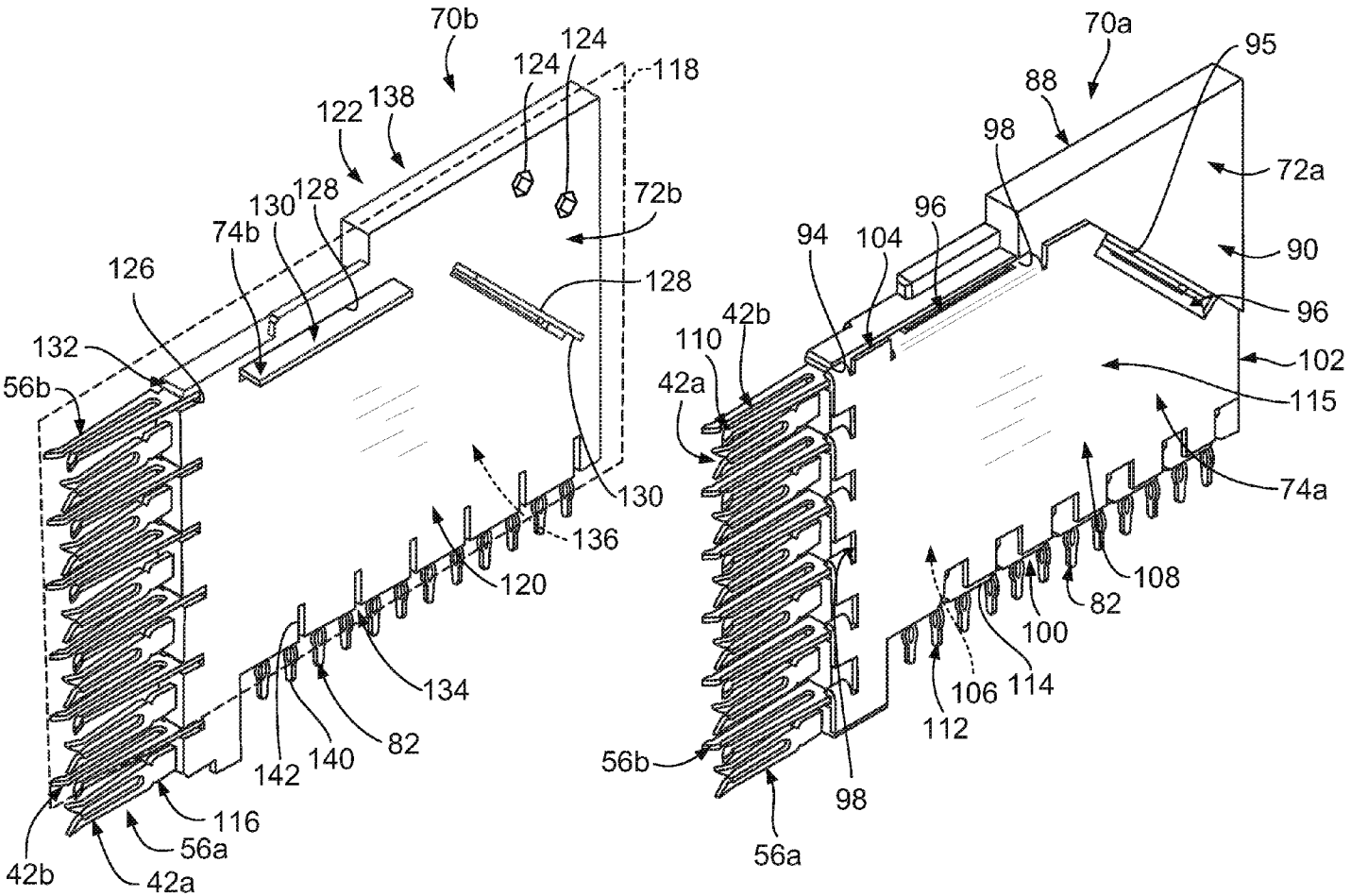
FIG. 6 is a perspective view of exemplary embodiment of ground shields coupled to the chicklets of the contact module shown in FIG. 4.

The body 72*a* has opposite inner and outer sides 88 and 90. The inner and outer sides 88 and 90 are optionally generally parallel to the lead frame plane 86. The mating ends 56*a* of the signal contacts 42*a* may be generally centered between the inner and outer sides 88 and 90. Optionally, the inner side 88 is planar. The outer side 90 may include a recess that receives the ground shield 74*a* (FIGS. 4 and 6). In the exemplary embodiment, the body 72*a* includes securing features 92 for securing the chicklet 70*a* together with chicklet 70*b* (FIGS. 4 and 6). In the exemplary embodiment, the securing features 92 are represented by pegs that extend outwardly from the inner side 88, and may be referred to hereinafter as "pegs 92". The pegs 92 may be cylindrical in shape and/or include other shapes. Other types of securing features may be used in alternative embodiments, such as an opening, a fastener, a latch, an adhesive, and/or the like. Any number of securing features 92 may be used. More than one type of securing features 92 may be provided. The body 72*a* includes optional grooves 94 at the corner of the front edge and outer side 90 that are configured to receive portions of the ground shield 74*a*.

FIG. 6 is a perspective view of the ground shield 74*a* coupled to the chicklet 70*a*. The ground shield 74*a* is coupled to the outer side 90 of the body 72*a*. The body 72*a* includes slots 95. The ground shield 74*a* includes grounding tabs 96 received in the slots 95. Optionally, the grounding tabs 96 extend beyond the inner side 88 such that the grounding tabs 96 engage the chicklet 70*b*. The ground shield 74*a* includes a forward mating edge 98 and a bottom mounting edge 100 that is generally perpendicular to the mating edge 98. The ground shield 74*a* also includes a rear edge 102 opposite the mating edge 98 and a top edge 104 opposite the mounting edge 100. The ground shield 74*a* has an inner side 106 and an outer side 108. The inner side 106 generally faces the body 72*a* of the chicklet 70*a* and the outer side 108 generally faces away from the body 72*a*.

Figure 8:
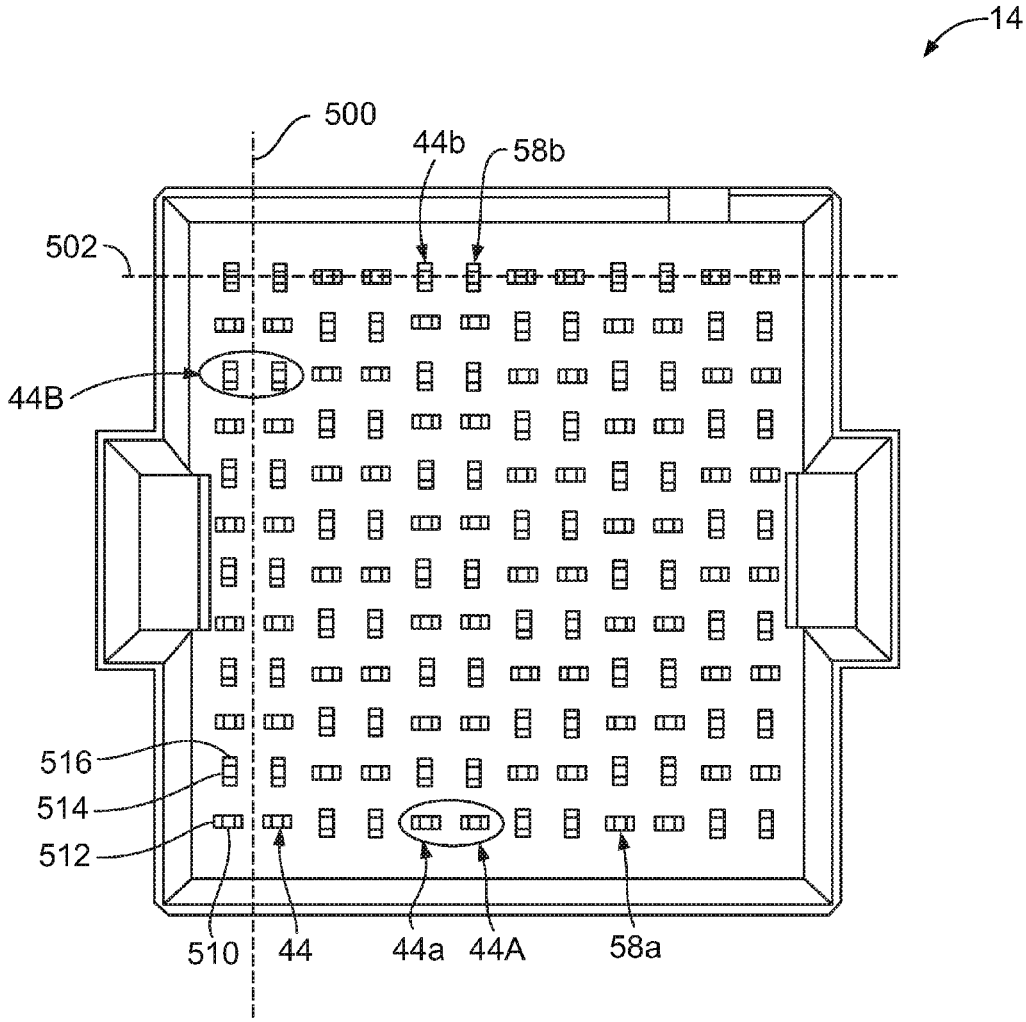
FIG. 8 is a front elevational view of an exemplary embodiment of a header assembly of the electrical connector system shown in FIG. 1.
Figure 9:
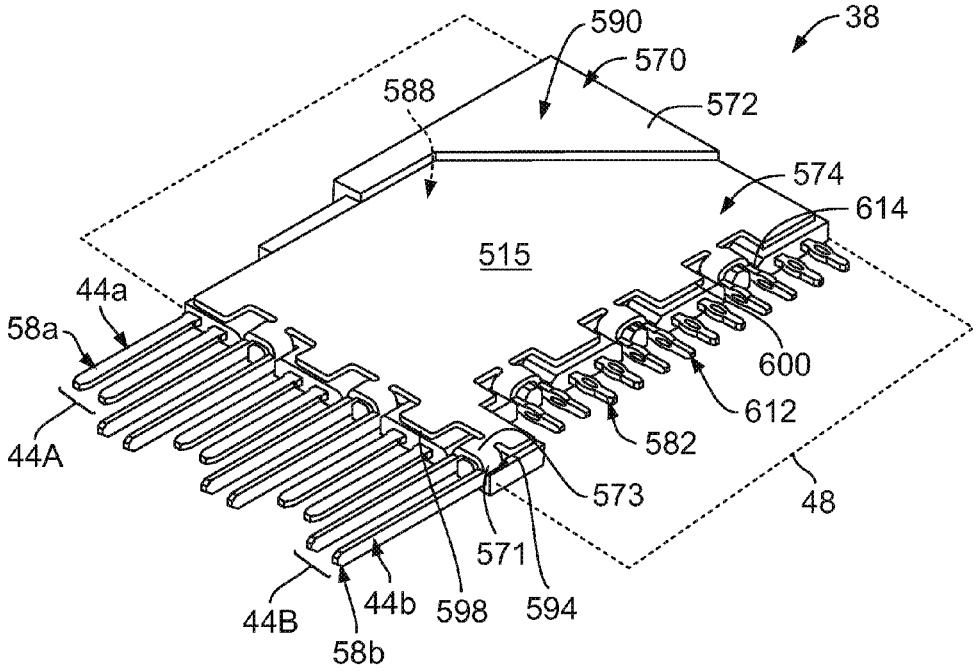
FIG. 9 is a perspective view an exemplary embodiment of a contact module of the header assembly shown in FIG. 8.

In the exemplary embodiment, the ground shield 74*a* includes the ground contacts 42*b*, which extend from the mating edge 98. The ground contacts 42*b* optionally extend outward from the inner side 106. The ground contacts 42*b* are arranged along the mating edge 98 in a predetermined pattern and are aligned with the grooves 94. The two beams of the ground contacts 42*b* represent spring fingers that are deflectable. The mating ends 56*b* of the ground contacts 42*b* include mating interfaces 110. Each mating interface 110 is configured for mating with the mating end 56*b* of the corresponding ground contact 44*b* of the header assembly 14 (FIGS. 1, 8, and 9). The mating ends 56*b* of the ground contacts 42*b* are interspersed between the mating ends 56*a* of the signal contacts 42*a*.

The ground shield 74*a* includes shield tails 112 that extend downward and inward from the mounting edge 100. The shield tails 112 may include one or more eye-of-the-needle type contacts that fit into vias in the printed circuit 16 (FIG. 1). Other types of contacts may be used for through hole mounting and/or surface mounting to the printed circuit 16. The bulk of each shield tail 112 is positioned inward with respect to the ground shield 74*a*, which is generally towards the contact chicklet 70*a*. The shield tails 112 fit in slots 114 (best seen in FIG. 5) formed in the body 72*a*. The shield tails 112 may be stamped from a ground plate 115 defining the ground shield 74*a* and then bent inward with respect to the ground plate 115. The shield tails 112 are optionally aligned with, and extend along, the lead frame plane 86 (FIG. 5). The shield tails 112 are interspersed between the mounting ends 82 of the signal contacts 42*a*. The shield tails 112 are electrically commoned with one another by the ground plate 115. Similarly, the ground contacts 42*b* are electrically commoned with one another by the ground plate 115.

The chicklet 70*b* includes a lead frame (not shown) having metal conductors that define the signal contacts 42*a*. The signal contacts 42*a* of the chicklet 70*b* cooperate with corresponding signal contacts 42*a* of the chicklet 70*a* to carry differential pair signals. Each signal contact 42*a* has the mating end 56*a* and the mounting end 82 that are both exposed beyond edges of the body 72*b*. In the exemplary embodiment, the mating end 56*a* includes a jogged section 116. The signal contacts 42*a* are generally coplanar with one another along a lead frame plane 118. The lead frame plane 118 may be substantially centered within the body 72*b*. The jogged section 116 may transition the mating end 56*a* out of the lead frame plane 118.

The body 72*b* has opposite inner and outer sides 120 and 122, respectively. The inner and outer sides 120 and 122, respectively, are optionally generally parallel to the lead frame plane 118. The signal contacts 42*a* of the body 72*b* may be generally centered between the inner and outer sides 120 and 122, respectively, thereof. Optionally, the inner side 120 is planar. The outer side 122 includes an optional recess that receives the ground shield 74*b*. In the exemplary embodiment, the body 72*b* includes securing features 124 for securing the chicklet 70*a* together with the chicklet 70*b*. The exemplary securing features 124 are represented by openings, and may be referred to hereinafter as "openings 124". The openings 124 are hexagon shaped to provide an interference fit with the securing features 92 (FIG. 5) of the chicklet 70*a*, however other shapes are possible. Other types of securing features may be used in alternative embodiments, such as a pin, a peg, a fastener, a latch, and adhesive, and/or the like. Any number of securing features 124 may be used. More than one type of securing features 124 may be provided. In an exemplary embodiment, the body 72*b* includes grooves 126 at the corner of the front edge and outer side 122 that are configured to receive portions of the ground shield 74*b*.

The ground shield 74*b* is coupled to the outer side 122 of the body 72*b*. The body 72*b* includes slots 128. The ground shield 74*b* includes grounding tabs 130 received in the slots of the body 72*b*. Optionally, the grounding tabs 130 extend beyond the inner side 120 of the body 72*b* such that the grounding tabs 130 engage the chicklet 70*a*. The ground shield 74*b* includes a forward mating edge 132 and a bottom mounting edge 134 that is generally perpendicular to the mating edge 98. The ground shield 74*b* has an inner side 136 and an outer side 138. The inner side 136 generally faces the body 72*b* of the chicklet 70*b*. In the exemplary embodiment, the ground shield 74*b* includes the ground contacts 42*b*, which extend from the mating edge 132. The ground contacts 42*b* optionally extend outward from the inner side 136. The ground contacts 42*b* are arranged along the mating edge 132 in a predetermined pattern and are aligned with the grooves 126 of the body 72*b*. The mating ends 56*b* of the ground contacts 42*b* are interspersed between the mating ends 56*a* of the signal contacts 42*a* on the chicklet 70*b*.

The ground shield 74*b* includes shield tails 140 that extend downward and inward from the mounting edge 134. The shield tails 140 may include one or more eye-of-the-needle type contacts that fit into vias in the printed circuit 16. Other types of contacts may be used for through hole mounting and/or surface mounting to the printed circuit 16. The bulk of each shield tail 140 is positioned inward with respect to the ground shield 74*b*, which is generally towards the contact chicklet 70*b*. The shield tails 140 fit in slots 142 formed in the body 72*b*. The shield tails 140 may be stamped from a ground plate (not shown) defining the ground shield 74*b* and then bent inward with respect to the ground plate. The shield tails 140 are optionally aligned with, and extend along, the lead frame plane 118. The shield tails 140 are interspersed between each of the mounting ends 82 of the signal contacts 42*a*. The shield tails 140 are electrically commoned with one another by the ground plate. Similarly, the ground contacts 42*b* are electrically commoned with one another by the ground plate.

Referring again to FIG. 4, the chicklets 70*a* and 70*b* are aligned with one another and mated together to form the contact module 28. When mated, the pegs 92 (FIG. 5) of the chicklet 70*a* are received in the openings 124 (FIG. 6) of the chicklet 70*b*. The pegs 92 may be held by an interference fit within the openings 124 to securely hold the chicklets 70*a* and 70*b* together.

When mated, the grounding tabs 96 are received within the slots 128 (FIG. 6) of the chicklet 70*b*. For example, the slots 128 may be wide enough to accommodate both grounding tabs 96 and 130. The grounding tabs 96 include barbs (not shown) that engage the slots 128 to secure the chicklets 70*a* and 70*b* together. The grounding tabs 96 engage the grounding tabs 130 within the slots 128 to electrically common the ground shields 74*a* and 74*b*. Similarly, when mated, the grounding tabs 130 are received within the slots 95 of the chicklet 70*a*. For example, the slots 95 may be wide enough to accommodate both grounding tabs 96 and 130. The grounding tabs 130 include barbs (not shown) that engage the slots 95 to secure the chicklets 70*a* and 70*b* together. The grounding tabs 130 engage the grounding tabs 96 within the slots 95 to electrically common the ground shields 74*a* and 74*b*.

The mating ends 56*a* of the signal contacts 42*a* of both the chicklets 70*a* and 70*b* are horizontally aligned directly across from one another on either side of the contact module plane 46. The mating ends 56*b* of the ground contacts 42*b* are also horizontally aligned directly across from one another on either side of the contact module plane 46. Each of the mating ends 56*a* of the signal contacts 42*a* receive the mating end 58*a* of the corresponding signal contact 44*a* (FIGS. 1 and 8-11) of the header assembly 14 (FIGS. 1, 8, and 11).

In the exemplary embodiment, the mating ends 56*a* of the signal contacts 42*a* are oriented differently from the mating ends 56*b* of the ground contacts 42*b*. The mating ends 56*a* of the signal contacts 42*a* include broadside surfaces 410 and edgeside surfaces 412 extending between the broadside surfaces 410. The edgeside surfaces 412 may be narrower than the broadside surfaces 410. The broadside surfaces 410 are oriented generally parallel to the columns 66 (FIG. 3) and the contact module plane 46, and the edgeside surfaces 412 are oriented generally parallel to the rows 68 (FIG. 3) and generally perpendicular to the contact module plane 46. The mating ends 56*b* of the ground contacts 42*b* include broadside surfaces 414 and edgeside surfaces 416 extending between the broadside surfaces 414. The broadside surfaces 414 are oriented generally parallel to the rows 68, and the edgeside surfaces 416 are oriented generally parallel to the columns 66 and the contact module plane 46. In other words, the ground contact mating ends 56*b* are rotated 90° relative to the signal contact mating ends 56*a*. Because the ground contact mating ends 56*b* are rotated 90° relative to adjacent signal contact mating ends 56*a*, adjacent differential pairs 42A of signal contact mating ends 56*a* within a column 66 can be positioned closer together, which may increase an overall density of the receptacle assembly 12.

In alternative embodiments, the mating ends 56*a* and/or 56*b* of the signal contacts 42*a* and the ground contacts 42*b*, respectively, may have an angular orientation with respect to the columns 66 and the rows 68. For example, the mating ends 56*a* and/or 56*b* of the signal contacts 42*a* and the ground contacts 42*b*, respectively, may be turned approximately 45° with respect to the columns 66 and the rows 68. Such an arrangement may affect the broadside and/or edgeside coupling between the mating ends 56*a* of the signal contacts 42*a*.

Figure 7:
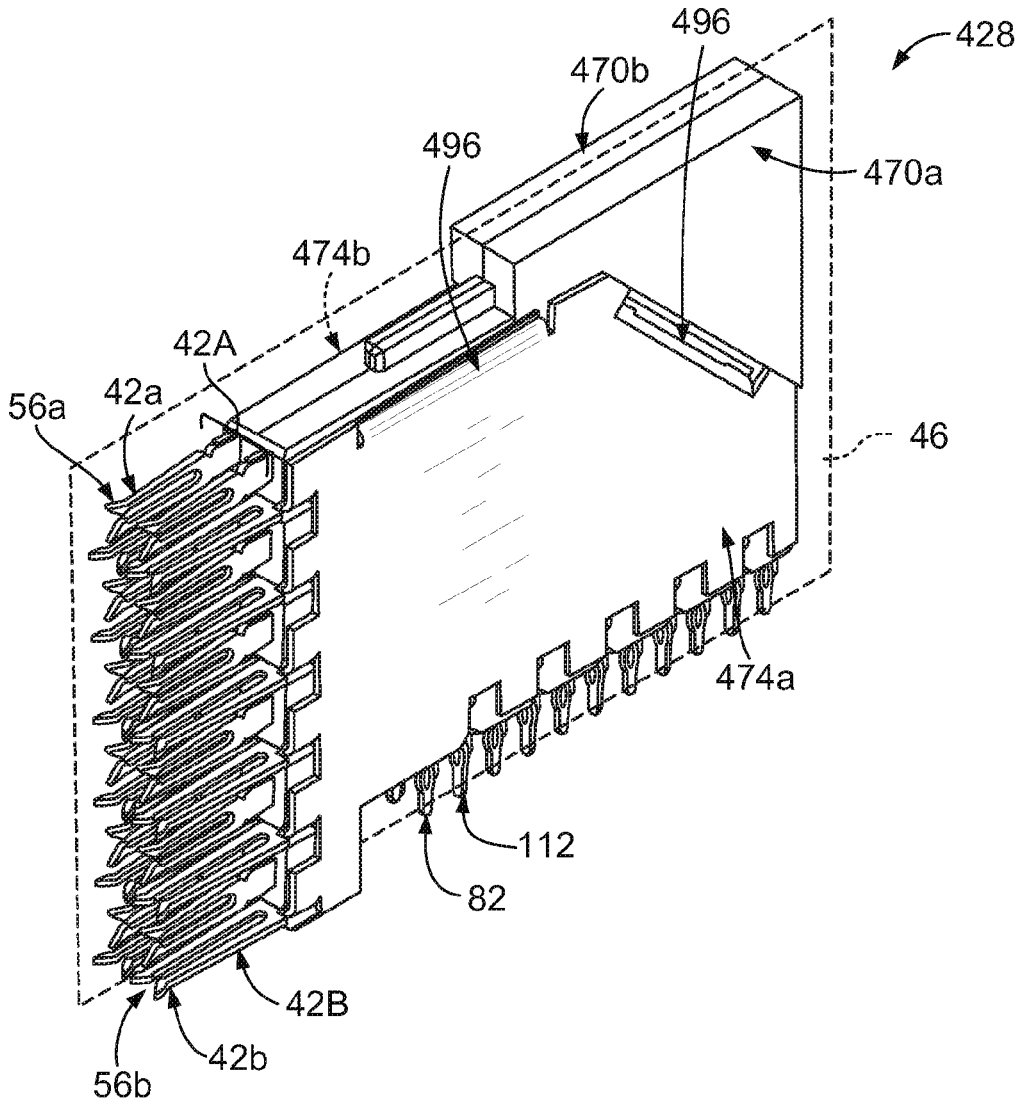
FIG. 7 is a perspective view of an exemplary embodiment of another contact module for the receptacle assembly shown in FIG. 2.

FIG. 7 is a perspective view of an exemplary embodiment of the contact module 428 for the receptacle assembly 12 (FIGS. 1-3 and 11). The contact module 428 is substantially similar to the contact module 28 (FIGS. 1, 2, 4, and 11), however the contact module 428 has a different arrangement of signal and ground contacts 42*a* and 42*b*, respectively.

The contact module 428 includes two chicklets 470*a* and 470*b*. The chicklets 470*a* and 470*b* both have signal contacts 42*a*, which are arranged as differential pairs 42A, with one of the signal contacts 42*a* of each differential pair 42A being held by the chicklet 470*a*, and with the other of the signal contacts 42*a* of each differential pair 42A being held by the chicklet 470*b*. The contact module plane 46 is defined along the line of intersection between the chicklets 470*a* and 470*b*. The signal contacts 42*a* of each differential pair 42A include mating ends 56*a* disposed on opposite sides of the contact module plane 46, and also include mounting ends 82 disposed on opposite sides of the contact module plane 46.

Each of the chicklets 470*a* and 470*b* has a ground shield 474*a* and 474*b*, respectively. The ground shields 474*a* and 474*b* include ground contacts 42*b* having mating ends 56*b* that are aligned directly across from one another on either side of the contact module plane 46 and shield tails 112 that are aligned directly across from one another on either side of the contact module plane 46. The aligned mating ends 56*b* of the ground contacts 42*b* cooperate to define a pair 42B of ground contacts 42*b*. The ground shields 474*a* and 474*b* are electrically commoned by grounding tabs 496 that extend through the bodies of the chicklets 470*a* and 470*b*.

The pairs 42B of the mating ends 56*b* of the ground contacts 42*b* are interspersed between the differential pairs 42A of the mating ends 56*a* of the signal contacts 42*a*. The pattern of mating ends 56*a* and 56*b* of the contact module 428 differs from the pattern of the mating ends 56*a* and 56*b* of the contact module 28 (FIGS. 1, 4, and 11). For example, with the contact module 428, a first differential pair 42A of the mating ends 56*a* of the signal contacts 42*a* is at an upper-most position along the front edge, followed by a pair 42B of the mating ends 56*b* of the ground contacts 42*b*, then followed by a differential pair 42A of the mating ends 56*a* of the signal contacts 42*a* and so on vertically down the front edge.

When the contact modules 28 and 428 are loaded into the housing 22 (FIGS. 1 and 2), the pattern of the mating ends 56*a* and 56*b* of the signal and ground contacts 42*a* and 42*b*, respectively, may be altered by alternating the contact modules 28 and 428. As such, the vertical position of the mating ends 56*a* of the signal contacts 42*a* may be changed in adjacent rows 68 (FIG. 3) by sandwiching a contact module 28 between two of the contact modules 428, and vice versa.

FIG. 8 is a front elevational view of the header assembly 14 illustrating the mating ends 58*a* and 58*b* of the signal contacts 44*a* and the ground contacts 44*b*, respectively. The mating ends 58*a* and 58*b* are arranged in a matrix of columns 500 and rows 502. The mating ends 58*a* of the signal contacts 44*a* are arranged in differential pairs 44A, with adjacent differential pairs 44A within each row 502 being separated by a pair 44B of the mating ends 58*b* of the ground contacts 44*b*. Adjacent differential pairs 44A within each column 500 are also separated by a pair 44B of the mating ends 58*b* of the ground contacts 44*b*. In some alternative embodiments, adjacent differential pairs 44A of signal contacts mating ends 58*a* within a column 500 and/or within a row 502 are separated by any other number of ground contact mating ends 58*b*, such as, but not limited to, one or three ground contacts mating ends 58*b*.

The mating ends 58*a* within each differential pair 44A are aligned with one another within the corresponding row 502. In the exemplary embodiment, the mating ends 58*a* of the signal contacts 44*a* are oriented differently from the mating ends 58*b* of the ground contacts 44*b*. The mating ends 58*a* of the signal contacts 44*a* include broadside surfaces 510 and edgeside surfaces 512 extending between the broadside surfaces 510. The edgeside surfaces 512 may be narrower than the broadside surfaces 510. The broadside surfaces 510 are oriented generally parallel to the rows 502 and the edgeside surfaces 512 are oriented generally parallel to the columns 500. The mating ends 58*b* of the ground contacts 44*b* include broadside surfaces 514 and edgeside surfaces 516 extending between the broadside surfaces 514. The broadside surfaces 514 are oriented generally parallel to the columns 500 and the edgeside surfaces 516 are oriented generally parallel to the rows 502. In other words, the ground contact mating ends 58*b* are rotated 90° relative to adjacent signal contact mating ends 58*a*. The pattern of mating ends 58*a* and 58*b* of the signal contacts 44*a* and ground contacts 44*b*, respectively, in adjacent columns 500 alternates. Because the ground contact mating ends 58*b* are rotated 90° relative to adjacent signal contact mating ends 58*a*, adjacent differential pairs 44A of signal contact mating ends 58*a* within a column 500 can be positioned closer together, which may increase an overall density of the header assembly 14.

In alternative embodiments, the mating ends 58*a* and/or 58*b* of the signal contacts 44*a* and the ground contacts 44*b*, respectively, may have an angular orientation with respect to the columns 500 and the rows 502. For example, the mating ends 58*a* and/or 58*b* of the signal contacts 44*a* and the ground contacts 44*b*, respectively, may be turned approximately 45° with respect to the columns 500 and the rows 502. Such an arrangement may affect the broadside and/or edgeside coupling between the mating ends 58*a* of the signal contacts 44*a*.

FIG. 9 is a perspective view an exemplary embodiment of the contact module 38 of the header assembly 14 (FIGS. 1, 8, and 11). The contact module 38 includes a chicklet 570. In the exemplary embodiment, the chicklet 570 is formed with an overmolded lead frame type of structure, however the chicklet 570 is not limited to such structure. The chicklet 570 includes a body 572 formed by the dielectric material of the overmold, which encases a lead frame (not shown). The lead frame includes a plurality of stamped and formed metal conductors initially held together by a frame or carrier (not shown) that is ultimately removed. The metal conductors define the signal contacts 44*a*, which are arranged as the differential pairs 44A. The signal contacts 44*a* are configured to carry data signals. In some alternative embodiments, other types of contacts may be provided in addition to, or in the alternative to, the signal contacts 44*a*, such as ground contacts, power contacts, and the like.

The signal contacts 44*a* include the mating end 58*a* and a mounting end 582 that are both exposed beyond edges of the body 572. In the exemplary embodiment, the mounting end 582 constitutes an eye of the needle type contact that is configured to be received within a via of the printed circuit 18 (FIG. 1). The mating end 58*a* extends forwardly from a front end of the body 572. In the exemplary embodiment, the mating end 58*a* constitutes a blade type of contact that is configured to be received by and mate with the tuning fork type mating end 56*a* (FIGS. 3-7 and 11) of the corresponding signal contact 42*a* (FIGS. 3-7 and 11). Other types of contacts may be used in alternative embodiments for mating with the tuning fork type of signal contact 42*a* or other types of signal contacts.

The signal contacts 44*a* transition between the mating and mounting ends 58*a* and 582, respectively, within the body 572. In the exemplary embodiment, the chicklet 570 is a right angle chicklet with the mating end 58*a* being oriented generally perpendicular with respect to the mounting end 582. Optionally, the signal contacts 44*a* are generally coplanar with one another along the contact module plane 48. The contact module plane 48 may be substantially centered within the body 572.

The body 572 has opposite inner and outer sides 588 and 590. The inner and outer sides 588 and 590 are optionally generally parallel to the contact module plane 48. The mating ends 58*a* of the signal contacts 44*a* may be generally centered between the inner and outer sides 588 and 590. Optionally, the inner side 588 and/or the outer side 590 is planar.

The body 572 includes optional grooves 594 at the corner of the front edge and outer side 590 that are configured to receive portions of a ground shield 574. The ground shield 574 is coupled to the outer side 590 of the body 572. In the exemplary embodiment, the ground shield 574 includes the ground contacts 44*b*, which extend from a mating edge 598 of the ground shield 574. The ground contacts 44*b* are arranged along the mating edge 598 in a predetermined pattern and are aligned with the grooves 594. The mating ends 58*b* of the ground contacts 44*b* are aligned in pairs 44B. The pairs 44B of the mating ends 58*b* of the ground contacts 44*a* are interspersed between the differential pairs 44A of the mating ends 58*a* of the signal contacts 44*a*. The mating end 58*b* of each ground contact 44*b* is positioned inward with respect to the ground shield 574, which is generally towards the contact chicklet 570. Bases 571 of the ground contacts 44*b* fit in the grooves 594 formed in the body 572. The bases 571 of the ground contacts 44*b* within each pair 44B extend from a common stem 573. The ground contacts 44*b* may be stamped from a ground plate 515 defining the ground shield 574 and then bent inward with respect to the ground plate 515. The mating ends 58*b* are optionally aligned with, and extend along, the contact module plane 48. The ground contacts 44*b* are electrically commoned with one another by the ground plate 515.

The ground shield 574 includes shield tails 612 that extend downward and inward from a mounting edge 600 of the ground shield 574. The shield tails 612 may include one or more eye-of-the-needle type contacts that fit into vias in the printed circuit 18. Other types of contacts may be used for through hole mounting and/or surface mounting to the printed circuit 18. The bulk of each shield tail 612 is positioned inward with respect to the ground shield 574, which is generally towards the chicklet 570. The shield tails 612 fit in slots 614 formed in the body 572. The shield tails 612 may be stamped from the ground plate 515 defining the ground shield 574 and then bent inward with respect to the ground plate 515. The shield tails 612 are optionally aligned with, and extend along, the contact module plane 48. The shield tails 612 are interspersed between the mounting ends 582 of the signal contacts 44*a*. The shield tails 612 are electrically commoned with one another by the ground plate 515.

Figure 10:
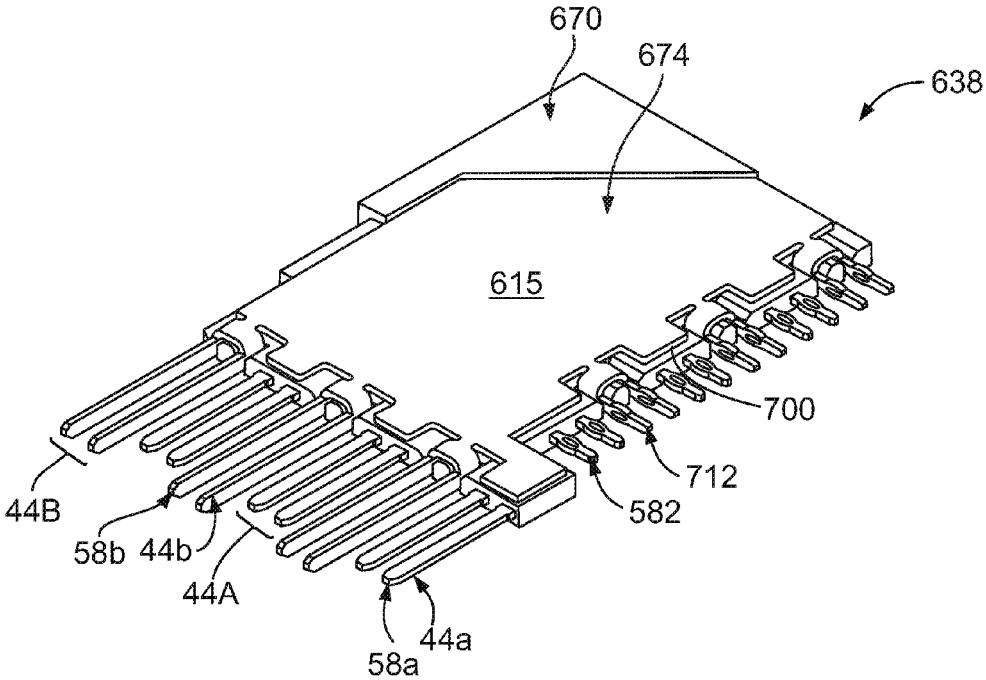
FIG. 10 is a perspective view of an exemplary embodiment of another contact module for the header assembly shown in FIG. 8.
Figure 11:
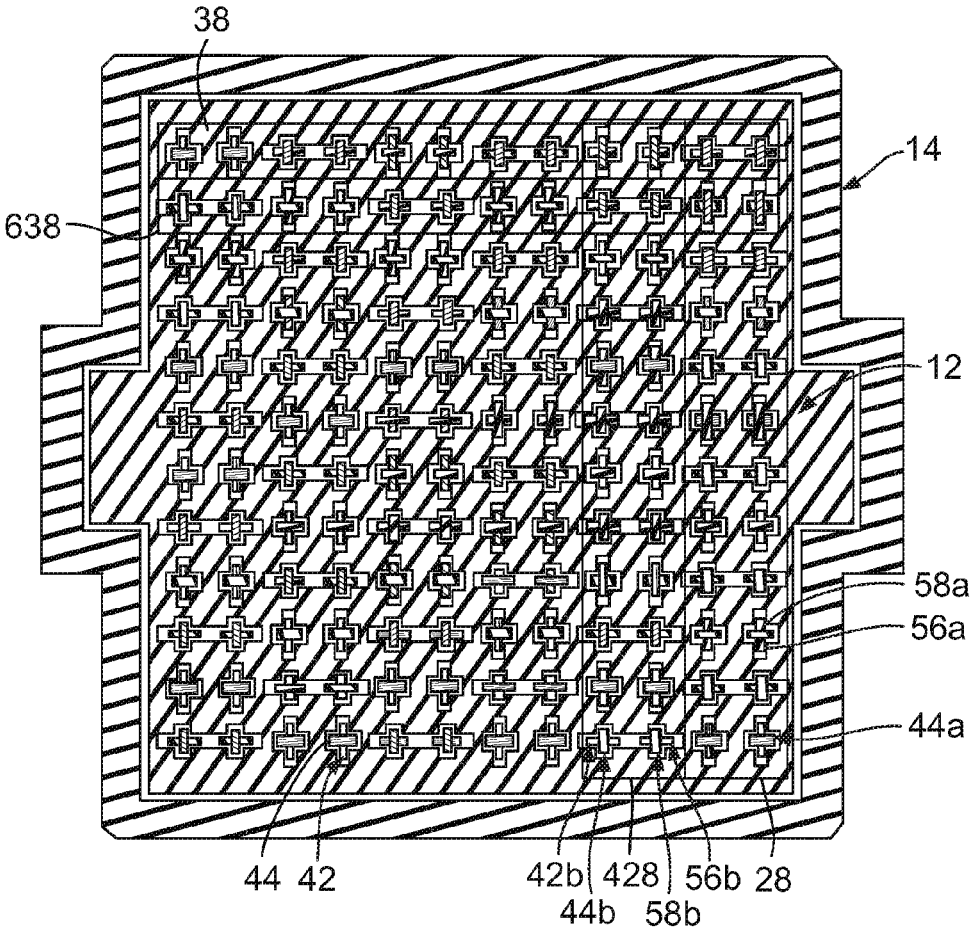
FIG. 11 is cross-sectional view of the receptacle assembly and header assembly in a mated position.

FIG. 10 is a perspective view of an exemplary embodiment of another contact module 638 for the header assembly 14 (FIGS. 8 and 11). The contact module 638 is substantially similar to the contact module 38 (FIGS. 1, 9, and 11), however the contact module 638 has a different arrangement of signal and ground contacts 44*a* and 44*b*, respectively. The contact module 638 includes a chicklet 670 having the signal contacts 44*a*, which are arranged as the differential pairs 44A. The signal contacts 44*a* include the mating ends 58*a* and the mounting ends 582.

The chicklet 670 has a ground shield 674, which includes the ground contacts 44*b*. The mating ends 58*b* of the ground contacts 44*b* are arranged in the pairs 44B. The ground shield 674 includes shield tails 712 that extend downward and inward from a mounting edge 700 of the ground shield 674. The shield tails 712 are interspersed between the mounting ends 582 of the signal contacts 44*a*. The shield tails 712 and the ground contacts 44*b* are electrically commoned with one another by a ground plate 615 of the ground shield 674.

The pairs 44B of the mating ends 58*b* of the ground contacts 44*b* are interspersed between the differential pairs 44A of the mating ends 58*a* of the signal contacts 44*a*. The pattern of mating ends 58*a* and 58*b* of the contact module 638 differs from the pattern of the mating ends 58*a* and 58*b* of the contact module 38 (FIGS. 1, 9, and 11). For example, with the contact module 638, a first pair 44B of the mating ends 58*b* of the ground contacts 44*b* is at an upper-most position along the front edge, followed by a differential pair 42A of the mating ends 58*a* of the signal contacts 44*a*, then followed by a pair 44B of the mating ends 58*b* of the ground contacts 44*b* and so on vertically down the front edge.

When the contact modules 38 and 638 are loaded into the housing 32 (FIGS. 1 and 8), the pattern of the mating ends 58*a* and 58*b* of the signal and ground contacts 44*a* and 44*b*, respectively, may be altered by alternating the contact modules 38 and 638. As such, the vertical position of the mating ends 58*a* of the signal contacts 44*a* may be changed in adjacent rows 502 (FIG. 8) by sandwiching a contact module 38 between two of the contact modules 638, and vice versa.

FIG. 11 is cross-sectional view of the receptacle assembly 12 and the header assembly 14 in a mated position. Specifically, the cross section of FIG. 11 is taken through the respective mating ends 56 and 58 of the mating contacts 42 and 44 of the receptacle and header assemblies 12 and 14, respectively. FIG. 11 therefore illustrates mating of the mating ends 56*a* of the signal contacts 42*a* of the receptacle assembly 12 with the mating ends 58*a* of the signal contacts 44*a* of the header assembly 14. FIG. 11 also illustrates mating of the mating ends 56*b* of the ground contacts 42*b* of the receptacle assembly 12 with the mating ends 58*b* of the ground contacts 44*b* of the header assembly 14. Contact module 28 and 428 of the receptacle assembly 12 are shown in Phantom outline. Similarly, contact modules 38 and 638 of the header assembly 14 are shown in Phantom outline. The contact modules 28 and 428 are oriented orthogonal with respect to the contact modules 38 and 638 of the header assembly 14.

As used herein, the term "printed circuit" is intended to mean any electric circuit in which the conducting connections have been printed or otherwise deposited in predetermined patterns on and/or within an electrically insulating substrate. The substrate may be a flexible substrate or a rigid substrate. The substrate may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate is a rigid substrate fabricated from epoxy-glass, which is sometimes referred to as a "circuit board".

The embodiments described and/or illustrated herein may provide an electrical connector having an increased density of signal contacts while maintaining or reducing signal loss. The embodiments described and/or illustrated herein may provide a receptacle assembly having skewless contacts. The embodiments described and/or illustrated herein may provide a header assembly and a receptacle assembly that may be mated together in two different relative positions that are 180° apart.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system for electrically connecting a receptacle printed circuit to a header printed circuit, the connector system comprising:

a header assembly configured to be mounted on the header printed circuit, the header assembly comprising header contacts; and a receptacle assembly configured to be mounted on the receptacle printed circuit and mated with the header assembly, the receptacle assembly comprising a housing and a contact module held within the housing, the contact module having separate first and second chicklets that are coupled together to define the contact module, first and second receptacle contacts are held by the contact module and arranged in a differential pair, the first and second receptacle contacts are engaged with the header contacts of the header assembly, the contact module comprising a first ground shield coupled to the first chicklet and a second ground shield coupled to the second chicklet, wherein the first receptacle contact of the differential pair is held by the first chicklet and the second receptacle contact of the differential pair is held by the second chicklet, wherein the first and second chicklets abut each other when the first and second chicklets are coupled together, and wherein the first and second ground shields engage one another when the first and second chicklets are coupled together to electrically join the first and second ground shields.

2. The system of claim 1, wherein the differential pair is a first differential pair, the contact module further comprising third and fourth receptacle contacts being arranged in a second differential pair, the first and second differential pairs being arranged in a column, the first and second receptacle contacts being arranged in a first row perpendicular to the column, the third and fourth receptacle contacts being arranged in a second row perpendicular to the column.

3. The system of claim 1, wherein the differential pair is a first differential pair, the contact module further comprising third and fourth receptacle contacts arranged in a second differential pair, a ground contact pair extending between the first and second differential pairs.

4. The system of claim 1, wherein at least one of the first or the second ground shield has a ground plate and a plurality of ground contacts extending therefrom, the ground contacts being electrically common with the ground plate.

5. The system of claim 1, wherein the first ground shield has a first grounding tab extending therefrom and the second ground shield has a second grounding tab extending therefrom, wherein the first and second grounding tabs engage one another when the first and second chicklets are coupled together to electrically join the first and second ground shields.

6. The system of claim 1, wherein the first chicklet comprises a first body having opposed inner and outer sides, the first receptacle contact of the first chicklet being encased within the first body and extending parallel to the inner and outer sides of the first chicklet, the second chicklet having a second body with opposed inner and outer sides, the second receptacle contact of the second chicklet being encased within the second body and extending parallel to the inner and outer sides of the second chicklet, the inner side of the first body abutting against the inner side of the second body when the first and second chicklets are coupled together.

7. The system of claim 1, wherein the first chicklet comprises a lead frame defining at least portion of the first receptacle contact and an overmold defining a dielectric body encasing the lead frame.

8. The system of claim 1, wherein the first and second chicklets are coupled together prior to being loaded into the housing.

9. The system of claim 1, wherein the first receptacle contact comprises a tuning fork.

10. The system of claim 1, wherein the first and second chicklets are discrete.

11. The system of claim 1, wherein the first and second chicklets are configured to be coupled together along a contact module plane, the first and second receptacle contacts being aligned within one another on opposite sides of the contact module plane.

12. A connector system for electrically connecting a receptacle printed circuit to a header printed circuit, the connector system comprising:

a header assembly configured to be mounted on the header printed circuit, the header assembly comprising header contacts; and a receptacle assembly configured to be mounted on the receptacle printed circuit and mated with the header assembly, the receptacle assembly comprising a housing and a contact module held within the housing, the contact module having separate first and second chicklets that are coupled together to define the contact module, first and second receptacle contacts are held by the contact module and arranged in a differential pair, the first and second receptacle contacts are engaged with the header contacts of the header assembly, wherein the first receptacle contact of the differential pair is held by the first chicklet and the second receptacle contact of the differential pair is held by the second chicklet, the contact module having a first ground shield coupled to the first chicklet, the first ground shield having a first grounding tab extending therefrom, the contact module having a second ground shield coupled to the second chicklet, the second ground shield having a second grounding tab extending therefrom, wherein the first and second grounding tabs engage one another when the first and second chicklets are coupled together to electrically join the first and second ground shields.

13. The system of claim 12, wherein the differential pair is a first differential pair, the contact module further comprising third and fourth receptacle contacts being arranged in a second differential pair, the first and second differential pairs being arranged in a column, the first and second receptacle contacts being arranged in a first row perpendicular to the column, the third and fourth receptacle contacts being arranged in a second row perpendicular to the column.

14. The system of claim 12, wherein the differential pair is a first differential pair, the contact module further comprising third and fourth receptacle contacts arranged in a second differential pair, a ground contact pair extending between the first and second differential pairs.

15. The system of claim 12, wherein the first chicklet comprises a first body having opposed inner and outer sides, the first receptacle contact of the first chicklet being encased within the first body and extending parallel to the inner and outer sides of the first chicklet, the second chicklet having a second body with opposed inner and outer sides, the second receptacle contact of the second chicklet being encased within the second body and extending parallel to the inner and outer sides of the second chicklet, the inner side of the first body abutting against the inner side of the second body when the first and second chicklets are coupled together.

16. The system of claim 12, wherein the first chicklet comprises a lead frame defining at least portion of the first receptacle contact and an overmold defining a dielectric body encasing the lead frame.

17. The system of claim 12, wherein the first receptacle contact comprises a tuning fork.

18. The system of claim 12, wherein the first and second chicklets are discrete.

19. The system of claim 12, wherein the first and second receptacle contacts extend from a mating edge of the receptacle assembly, the mating edge being generally orthogonal with respect to the mounting edge of the receptacle assembly.

20. The system of claim 12, wherein the connector system is an orthogonal connector system and the header printed circuit is oriented orthogonally with respect to the receptacle printed circuit, the header assembly being configured to be mounted on the header printed circuit along a header mounting edge, the receptacle assembly being configured to be mounted on the receptacle printed circuit along a receptacle mounting edge that is generally orthogonal with respect to the header mounting edge.

* * * * *